United States Patent [19]

Ito et al.

[11] Patent Number: 4,658,756

[45] Date of Patent: Apr. 21, 1987

[54] IMAGING HOLDING MEMBER

[75] Inventors: Hiroshi Ito; Tomohiro Kimura, both of Toride, Japan

[73] Assignee: Canon Kabushiki Kaisha, Tokyo, Japan

[21] Appl. No.: 636,807

[22] Filed: Aug. 3, 1984

Related U.S. Application Data

[63] Continuation of Ser. No. 335,457, Dec. 29, 1981, abandoned, which is a continuation of Ser. No. 175,020, Aug. 4, 1980, abandoned.

[30] Foreign Application Priority Data

Aug. 7, 1979 [JP] Japan ..... 54-100589

[51] Int. Cl.[4] ..... G03G 15/06

[52] U.S. Cl. ..... 118/652; 430/67

[58] Field of Search ..... 430/66, 67; 525/58; 118/652

[56] References Cited

U.S. PATENT DOCUMENTS

| | | | |
|---|---|---|---|
| 2,753,308 | 7/1956 | Landrigan | 525/58 X |
| 2,976,257 | 3/1961 | Dawe et al. | 525/58 X |
| 4,092,173 | 8/1978 | Novak et al. | 430/66 X |

FOREIGN PATENT DOCUMENTS

| | | | |
|---|---|---|---|
| 48-26536 | 11/1973 | Japan | 430/67 |
| 144445 | 11/1975 | Japan | 430/67 |
| 01630 | 1/1979 | Japan | 430/67 |

*Primary Examiner*—John D. Welsh

*Attorney, Agent, or Firm*—Fitzpatrick, Cella, Harper & Scinto

[57] ABSTRACT

An image holding member having on its surface an insulating layer consisting principally of a hardenable resin, a lubricant, and polyvinyl butyral. The image holding member exhibits an excellent surface lubricating property, and hence durability and cleaning properties.

4 Claims, No Drawings

IMAGING HOLDING MEMBER

This application is a continuation of application Ser. No. 335,457 filed Dec. 29, 1981, now abandoned which in turn is a continuation of parent application Ser. No. 175,020, filed Aug. 4, 1980, now abandoned.

BACKGROUND OF THE INVENTION

1. Field of the Invention

This invention relates to an image holding member to hold thereon an electrostatic image and/or a toner image.

2. Description of the Prior Art

For the image holding member, on which the toner image and electrostatic image are formed, there exists electrophotographic photosensitive members and other image holding members.

The electrophotographic photosensitive member can take various embodiments for obtaining predetermined characteristics, depending upon the kinds of the electrophotographic process to be adopted. As a representative electrophotographic photosensitive member, there is one which has a photoconductive layer formed on a base member (or a substrate), and another one that has an insulative layer provided on its surface. These electrophotographic photosensitive members are widely used. The photosensitive member constructed with the substrate and the photoconductive layer is used in the image formation by the most general electrophotographic process, i.e., the image formation by electric charging, image exposure, image development, and, further, image transfer, if necessary. In the photosensitive member having the insulating layer, this insulating layer is for various purposes; for example, protection of the photoconductive layer, improvement in the mechanical strength of the photosensitive member, improvement in the dark decay characteristic, adaptation of the photosensitive member to a particular electrophotographic process (pollution prevention), and various others. Representative examples of the electrophotographic process using the photosensitive member having such insulating layer are: U.S. Pat. No. 2,860,048, Japanese Patent Publication No. 41-16429, Japanese Patent Publication No. 38-15446 (corresponding to U.S. Pat. No. 3,146,145), Japanese Patent Publication No. 46-3713 (corresponding to U.S. Pat. No. 3,607,258), Japanese Patent Publication No. 42-23910 (corresponding to U.S. Pat. No. 3,666,363), Japanese Patent Publication No. 43-24748 (corresponding to U.S. Pat. No. 3,734,609), Japanese Patent Publication No. 42-19747 (corresponding to U.S. Pat. No. 3,457,070), Japanese Patent Publication No. 36-4121 (corresponding to U.S. Pat. No. 3,124,456), and others.

The electrophotographic photosensitive member is utilized in a predetermined electrophotographic process, during which an electrostatic image is formed, and this electrostatic image is developed to be visualized.

In the following, a few representative examples of the process, in which other image holding members are used, will be explained.

(1) A process such as disclosed in Japanese Patent Publication No. 32-7115, Japanese Patent Publication No. 32-8204, and Japanese Patent Publication No. 43-1559, wherein, with a view to improving the repetitive use of the electrophotosensitive member, an electrostatic image formed on it is transferred to another image holding member for development, and then the toner image is further transferred onto a recording member.

(2) A process for forming an electrostatic image on another image holding member in correspondence with the electrostatic image formed on the electrophotosensitive member, such as disclosed in Japanese Patent Publication No. 45-30320 (corresponding to U.S. Pat. No. 3,680,954), Japanese Patent Publication No. 48-5063 (corresponding to U.S. Pat. No. 3,645,614), Laid-Open Japanese Patent Application No. 51-341 (corresponding to U.S. Ser. No. 771,309 filed Feb. 23, 1977), and others, wherein an electrostatic image is formed by a predetermined electrophotographic process onto a screen-shaped electrophotosensitive member having a multitude of tiny openings; then a corona charging treatment is effected on another image holding member through this electrostatic image, thereby modulating the corona ion current to form the electrostatic image on the other image holding member; thereafter the electrostatic image is developed with toner, and this toner image is transferred onto a recording member to be the final reproduction image.

(3) A process by another electrostatic image forming process, according to which an electrical signal is applied to (multi-)needle electrode(s) to form an electrostatic image on the surface of the image holding member in accordance with the electrical signal.

The image holding members to be used for the electrophotographic process as stated in the above items (1) to (3) may only be insulative in their electrostatic holding surface, and need not have a photoconductive layer.

Thus, the member to hold thereon an electrostatic image or a toner image, which is an electrophotographic photosensitive member or a member having no photoconductive layer, as the image holding member, is required to have its electrical characteristics in accordance with the electrophotographic process to be adopted. In addition, durability and cleaning property also constitute important factors in the image holding member. In more detail, durability is required when the image holding member is repetitively used, while the cleaning property relates to the facility of removing the residual toner which has adhered to the surface of the image holding member. Both properties of which considerably affect the clear image formation and, further, prevention of the cleaning device from damage. On account of this, an insulating layer having excellent durability and cleaning property is desired for improving the durability and cleaning property of the image holding member.

SUMMARY OF THE INVENTION

In view of what has been mentioned in the foregoing, it is the fundamental object of the present invention to provide an image holding member having thereon an insulating layer with an excellent surface lubricating property, and hence excellent in its durability and cleaning property, and in which being the insulating layer is formed by coating it on the image holding member.

According to the present invention, there is provided an image holding member to hold thereon an electrostatic image or a toner image, characterized in that said image holding member has on its surface an insulating layer consisting principally of a curable resin, a lubricant, and polyvinyl butyral.

The foregoing object and other objects as well as specific materials to constitute the insulating layer according to the present invention will become more apparent from the following detailed description of the invention along with a few preferred examples thereof.

DESCRIPTION OF THE PREFERRED EMBODIMENTS

The insulating layer for the image holding member according to the present invention is principally composed of a hardenable or curable resin which contains therein a lubricating agent, or lubricant, and polyvinyl butyral resin. In case the surface lubricating property of the resin is not sufficient, addition of the lubricant is efficacious for improving the surface lubricating property.

For the lubricant to be used in the present invention, there may be employed appropriate powder material having the lubricating function. Representative lubricants are: polyethylene, polytetrafluoroethylene, polyethylene terephthalate, polyvinylidene fluoride, polyvinyl chloride, metal salts of stearic acid, paraffin wax, talc, and other substances which are substantially insoluble in general solvents. Of these various lubricants, such as polyethylene, polytetrafluoroethylene, and polyvinylidene fluoride are particularly suitable. Particle size of the lubricant should preferably be approximately 20 microns and below in the primary particle size.

For the insulating layer, those hardenable resins excellent in mechanical strength are recommended, since the layer is required to have mechanical strength. On the other hand, however, since such resins are apt to be inferior in their surface lubricating property, the effect to be derived from addition of the lubricant is significant.

The hardenable resins are polymerizable by heat, or energy rays such as electron beam, etc., and has such a molecular structure that an unsaturated group is introduced in the molecules consisting, for example, of acryl type, urethane type, polyester type, or epoxy type component elements. In particular, a low molecular weight oligomer is generally used as the hardenable resin. The characteristic of this oligomer is that, since it is of low molecular weight, its coating, processing, handling, etc. are very easy, and further its processing can be done rapidly due to its high polymerization speed by ultraviolet rays, etc. On the other hand, when the lubricant is dispersed in the hardenable resin, no favorable dispersion liquid capable of being coated can be obtained with the lubricant and the hardenable resin alone. While various studies and research have been carried out by the addition of various sorts of surfactants to effectively disperse the lubricant, it should nonetheless satisfy the electrical characteristics (particularly, charge sustaining property) when the resin is used as the insulating member. Finding of such a surfactant, however, is extremely difficult. In this connection, polyvinyl butyral resin has been found very effective for the satisfactory dispersion of the lubricant particles and for the addition of a third component which is capable of being coated without decreasing the electrical characteristics. The polymer can attain the intended objective of the present invention. Polyvinyl butyral resin is prepared by reacting butyl aldehyde with polyvinyl alcohol obtained by saponifying polyvinyl acetate. It is almost impossible to perfectly butyralize polyvinyl alcohol, and its maximum degree of butyralization is 81.6 mol% (or 86.47 wt.%). Accordingly, when butyral resin available in the general market is used, those having the degree of butyralization of 58 to 75 mol% are used. The quantity of polyvinyl butyral employed ranges from 0.1 to 50 parts by weight, or more desirably from 1 to 10 parts by weight, with respect to 100 parts by weight of the solid content of the hardenable resin. Excessive amounts of polyvinyl butyral resin beyond the abovementioned range would lower the inherent property of the hardenable resin, and the characteristic of the polyvinyl butyral resin itself emerges. It has further been verified that addition in small quantities of polyvinyl butyral resin improves the coating property of the hardenable resin, thereby making it possible to coat a uniform lubricant dispersion layer.

The adding quantity of the lubricant may be appropriately determined. Usually, 0.5 to 90 parts by weight, or more preferably 5 to 50 parts by weight, with respect to 100 parts by weight of the resin component contained in the insulating layer is suitable. For dispersing the lubricant, there may be used a dispersing device which is ordinarily employed, such as, for example, roll mill, sand mill, attrition mill, colloid mill, kneader, homogenizer, high speed impeller, super-sonic wave disperse, and so forth. The dispersing time is appropriately determined depending on the capacity of the dispersing device such as quantity of the lubricant, quantity of the total liquid, and others. The dispersing time is also adjusted by a grinding gauge, etc. until the dispersion material has a desired particle diameter. The thus obtained coating material can be formed into a seamless insulating layer on the drum-shaped image holding member, which method is more advantageous than in the case of adhering an insulating film thereon to make it the insulating layer. That is, the former insulating film makes it possible to dispense with a synchronizing mechanism owing to its having no seam on the circumference, hence the apparatus as a whole can be simplified in the aspect of the reproduction process.

The most representative construction where the image holding member is the electrophotographic photosensitive member is a laminated structure, in which the photoconductive layer is interposed between the substrate and the insulating layer. The substrate may be formed of various arbitrary materials such as metal plates of stainless steel, copper, aluminum, tin, etc., and shaped articles of paper, resin, and other plastic materials in cylindrical or sheet form. The substrate may be omitted depending on necessity.

The photoconductive layer is formed by the vacuum evaporation of inorganic photoconductive materials such as S, Se, PbO, and alloys and intermetallic compounds containing therein S, Se, Te, As, Sb, etc. singly or in combination. In case of adopting the sputtering method, those photoconductive materials of high melting point such as ZnO, CdS, CdSe, $TiO_2$, etc. may be deposited on the substrate to form the photoconductive layer. Also, in the case of forming the photoconductive layer by coating, there may be used organic photoconductive materials such as polyvinyl carbazole, anthracene, phthalocyanine, etc., those photoconductive materials which have been subjected to color-sensitization or Louis acid sensitization, and, further, a mixture of such photoconductive material and an insulative binder. Also, a mixture of the abovementioned inorganic photoconductive materials of ZnO, CdS, $TiO_2$, PbO, etc. and the insulative binder is suitable. For the insulative binder, there may be used various kinds of resins. Thickness of the photoconductive layer, though depending on the kind and characteristic of the photoconductive substance to be used, generally ranges from 5 to 100 microns, or, more preferably, from about 7 to 50 microns.

The most representative construction where the image holding member has no photoconductive layer is such that the insulating layer is directly formed on the substrate.

Generally speaking, when the insulating layer is provided mainly for the purpose of protecting of the image holding member, improving in its durability and dark decay characteristic, such insulating layer is formed relatively thin. When the image holding member is used for a particular electrophotographic process, the insulating layer to be provided is formed relatively thick. Thickness of the insulating layer usually ranges from 5 to 70 microns, or, more preferably, from 10 to 50 microns.

Since the insulating layer according to the present invention is small in its surface frictional resistance, it can provide the image holding member which is excellent in durability. In addition, it can provide excellent image quality, prevent the cleaning means from being damaged, and also prevent formation of a toner film on the surface layer.

EXAMPLE 1

Three photoconductive layers, each having 60 microns thickness, were formed on aluminum drums maintained at a temperature of 67° C. by evaporative deposition of Se with purity of 99.999% at 300° C. for 35 minutes using a bell jar with an internal vacuum of $1\times10^{-5}$ torr. One of the photoconductive drums thus treated was coated with a photo-curable urethane resin (a product of Kansai Paint K.K. sold under a tradename of "CK-8") by means of an immersing and drawing apparatus. After this coating, it was exposed to a high tension mercury lamp of 80 W/cm$^2$ to cure the coating by rotation of the drum, thereby forming the insulating layer of 10 microns thick. This operation was repeated three times, whereby the insulating layer of the total thickness of 30 microns was formed on the photoconductive layer. This drum is designated as "Specimen A".

50 parts by weight of polytetrafluoroethylene powder was added to, and mixed by agitation with a resin, prepared by dissolving 100 parts by weight of photocurable urethane acrylate (a product of Kansai Paint K.K. sold under a tradename of "CK-8") into methylethyl ketone. After which the mixture was placed in a ball mill to disperse the power material for consecutive five days on a rotating stand. The thus prepared coating material was coated over the photoconductive layer on another drum by means of the immersing and drawing apparatus in the same manner as in the abovementioned specimen A, followed by curing the same with ultraviolet rays, thereby forming the lubricating insulating layer thereon. It was observed that the coated surface caused agglomeration of the lubricant and irregularity in coating. This drum is designated as "Specimen B".

A coating solution was prepared by dispersing 50 parts by weight of polytetrafluoroethylene as the lubricant, 40 parts by weight of polyvinyl butyral (a product of Sekisui Chemical Co. Ltd., sold under a tradename of "Polyvinyl Butyral BMS", and 60 parts by weight of methylethyl ketone (20% methylethyl ketone solution) into 100 parts by weight of urethane acrylate (a product of Kansai Paint K.K. sold under a tradename of "CK-8") in a mixing ball mill for consecutive five days. This coating solution was coated over the photoconductive layer formed on the third drum by means of the immersing and drawing device, followed by curing the same with ultra-violet rays, thereby obtaining a film of 10 microns thick. This coating operation was repeated for three times to form the lubricant-dispersed insulating layer. This is designated as "Specimen C".

With the abovementioned specimen B, the surface condition of the photosensitive drum was inferior in that the dispersed particles are agglomerated and the overall surface thereof assumed an irregular matted form like the surface of a paper file, hence it was unsuitable as the surface layer of the photosensitive drum. Therefore, the lubricating property, image forming property, and durability of the photosensitive drum having thereon the abovementioned specimens A and C were tested by the process comprising primary negative (−) d.c. charging, simultaneous secondary a.c. charge removal and exposure, overall surface irradiation, dry development with a positive (+) toner, and cleaning treatment by a urethane cleaning blade (with hardness of 70, positioned at an angle of 30° with respect to the surface of the insulating layer, and with a blade pressure of 2.0 kg.). As a result of the test, it was observed that the specimen A had a frictional coefficient of 3.5 and produced sharp noise due to frictional sliding between the blade and the insulating layer, as the result of which damage occurred to the blade edge after 1,000 revolutions of the drum, and that the film of the developing agent has been formed on the surface of the drum.

On the other hand, with the specimen C, the photosensitive drum has a frictional coefficient of 0.9, hence it rotated smoothly and produced a good quality of image. Even after rotation of the drum for 10,000 revolutions, there could hardly be recognized substantial wear and tear at the blade edge, and scratches, etc. on the insulating layer surface due to cleaning. Also, no black dots due to adhesion of the toner could be observed at the non-image portion of the toner image thus formed.

In this example, the photosensitive drum of excellent durability same as that of the specimen C could be obtained, even when the insulating layer was formed with the following preparations (a) to (c).

| | |
|---|---|
| (a) Photo-curable polyester acrylate resin (a product of Toa Gosei Kagaku K.K. sold under a tradename of "ARONIX M 8060" | 100 parts by weight |
| Polyvinyl butyral (a product of Sekisui Chemical Co. Ltd. sold under a tradename of "S-LEC-D BM-1" | 5 parts by weight |
| Polytetrafluoroethylene (lubricant) (a product of Daikin Kogyo K.K. sold under a tradename of "LUBRON L-2" | 60 parts by weight |
| (b) Photo-curable epoxy-acrylate resin (a product of Dai-Nippon Ink Kagaku K.K. sold under a tradename of "UNIDICK V 5502" | 100 parts by weight |
| Polyvinyl butyral (a product of Sekisui Chemical Co. Ltd. sold under a tradename of "S-LEC-D BL-1" | 5 parts by weight |
| Polytetrafluoroethylene (lubricant) (a product of Asahi Glass K.K. sold under a tradename of | 60 parts by weight |

-continued

| | |
|---|---|
| "AFLONE TFE-G-8" | |
| (c) Photo-curable epoxy-acrylate resin (a product of Showa Kobunshi Kagaku K.K. sold under a tradename of "RIPOXY SP-1512X" | 100 parts by weight |
| Polyvinyl butyral (a product of Sekisui Chemical Co. Ltd. sold under a tradename of "S-LEC-D BLS" | 5 parts by weight |
| Polytetrafuoroethylene (lubricant) (a product of Daikin Kogyo K.K. sold under a tradename of "LUBRON L-5" | 60 parts by weight |

EXAMPLE 2

A cylindrical base member made of aluminum (200 $\phi \times 500$ mm) was dipped in a liquid prepared by diluting acryl resin (a product of Chugoku Toryo K.K. sold under a tradename of "PULSLAC 2000") with methylethyl ketone as the solvent in such a manner that its viscosity might be 90 cps. Then the cylindrical base member was drawn out of the liquid at a rate of 30 mm/min., after which it was irradiated by a mercury lamp of 4 KW for five minutes to cure, thereby forming the insulating layer of 10 microns thick. Thereafter, the same operation was repeated with the exception that the drawing rate alone was changed to 23 mm/min. to laminate another insulating layer of 5 microns over the initially formed insulating layer, thereby forming the insulating layer of the total thickness of 15 microns on the base member. This is designated as "Specimen D."

On the other hand, an insulating layer of acryl resin having thickness of 10 microns was provided on another cylindrical base member of aluminum (200 $\phi \times 500$ mm) by the same operation as that of the abovementioned specimen D. Over this insulating layer, there was further coated a coating material having viscosity of 100 cps and prepared by dispersing acryl resin (PULSLAC 2000) and polyvinylidene fluoride particles as a mixing ratio of 100:20 in methylethyl ketone and further treating the mixture in a ball mill. The coating operation was done by means of the immersing and drawing apparatus. It was found out that surface irregularity occurred, which appeared to be due to agglomeration of the dispersed particles same as the specimen B in Example 1 above.

Next, an acryl resin insulating film having thickness of 10 microns was provided on still another cylindrical base member of aluminum in the same manner as in the abovementioned specimen D. Then, on this acryl resin insulating layer, there was formed another insulating film of 5 microns thick by use of a mixture solution obtained by dissolving and dispersing (ball mill dispersion) acryl resin (PULSLAC 2000), polyvinylidene fluoride, and 20% solution of polyvinyl butyral (a product of Sekisui Chemical Co. Ltd. sold under a tradename of "SEKISUI S-LEC-D BLS") in methylethyl ketone as the solvent at a mixing ratio of 100:20:30. The thus coated drum with the insulating film is designated as "Specimen E". Using the specimens D and E as the image holding members, their durability against image development, image transfer and cleaning was tested, which took place in the process of forming an electrostatic image on a CdS screen photosensitive body utilizing a positive (+) dry developing agent and a urethane cleaning blade (having hardness of 70, positioned at an angle of 30° with respect to the surface insulating layer of the specimen, and having a blade pressure of 2.0 kg.). It was observed that the frictional coefficient of the specimen D was 2.6, owing to which noise from the frictional sliding (i.e. frictional sound occurring between the blade and the insulating layer) was sharp, i.e., the blade adge was worn out after 950 revolutions of the drum and scratches on the insulating layer due to the cleaning was considerable. With respect to the specimen E, on the other hand, the frictional coefficient thereof was 1.2 and the cylinder rotated smoothly, producing good image.

Even after 38,000 revolutions, there could be verified no wear and tear of the blade adge and the film formation due to fusion of the developing agent during the developing operation. Also, no toner adhesion at the non-image portion could be observed.

For the sake of comparison, particulate polyethylene having a particle diameter of 10 microns was used in the production of "Specimen F" in place of polyvinylidene fluoride used in preparation of the specimen E.

The insulating layer obtained from this material indicated its frictional coefficient of 1.1, which also exhibited satisfactory durability as in the specimen E.

Incidentally, the process, by which the lubricating property of each and every specimen is measured using the CdS screen photosensitive body, is as follows.

A photoconductive layer was coated onto a stainless steel net (having approximately 50 microns in each opening) to a thickness of 30 microns by the spray-coating method, composition of the photoconductive layer being 70 parts by weight of CdS powder and 30 parts by weight of silicon resin (a product of Shinetsu Silicon K.K. sold under a tradename of "KR-255"); the coating was dried at 80° C. for 15 minutes; after this, an insulating layer of 15 microns thick was formed on the photoconductive layer by the spray-coating technique, the insulating layer being composed of silicon resin (a product of Toshiba Silicon K.K. sold under a tradename of "TSR-144") containing therein a curing agent (Tradename: "CR-15").

The surface of the thus formed screen photosensitive body was charged to +450 V, followed by simultaneous a.c. charge removing and image exposure, to thereby form an electro-static image having a potential of −50 V at the light portion and +200 at the dark portion. In this state, the specimen was disposed at the side of the stainless steel net of the screen photosensitive body, to which a negative (−) corona charging was conducted through the screen photosensitive body. As the result, the electrostatic image formed on the specimen film is developed with toner, and the toner image was transferred onto paper under application of an image transfer voltage of approximately −6 KV, and fixed, thereby obtaining a visible image.

What we claim is:

1. An electrophotographic apparatus comprising a drum-shaped image holding member to hold an electrostatic image or a toner image thereon having on its surface a seamless insulating layer comprising a low molecular weight oligomer having dispersed therein a powdered lubricant to enhance surface lubrication properties of said cured oligomer and from about 0.1 to 50 parts per 100 parts oligomer solids of a polyvinyl butyral dispersant for said powdered lubricant, and a cleaning blade adapted to frictionally slide across the surface of said insulating layer to remove residual toner adhering to the surface; wherein the polyvinyl butyral is butryalated from 58 to 81.6 mole percent.

2. The electrophotographic apparatus as set forth in claim 1, wherein said lubricant is selected from the group consisting of polyethylene, polytetrafluoroethylene, and polyvinylidene fluoride.

3. The electrophotographic apparatus as set forth in claim 1 wherein said insulating layer is formed on a photoconductive layer.

4. The electrophotographic apparatus as set forth in claim 1, wherein the content of said lubricant ranges from 0.5 to 90 parts by weight with respect to 100 parts by weight of the resin component contained in said insulating layer.

* * * * *